US007681250B2

(12) United States Patent
Friedstrom

(10) Patent No.: US 7,681,250 B2
(45) Date of Patent: Mar. 23, 2010

(54) HYGIENIC MITTEN

(76) Inventor: Stephanie J. Friedstrom, 3309 Celedon Ct., Cincinnati, OH (US) 45251

( * ) Notice: Subject to any disclaimer, the term of this patent is extended or adjusted under 35 U.S.C. 154(b) by 208 days.

(21) Appl. No.: 11/624,484

(22) Filed: Jan. 18, 2007

(65) Prior Publication Data

US 2008/0172767 A1 Jul. 24, 2008

(51) Int. Cl.
*A41D 19/01* (2006.01)

(52) U.S. Cl. ..... 2/158; 2/161.6; 2/161.7; 15/227

(58) Field of Classification Search ..... 2/16, 2/158, 159, 161.6, 161.7, 161.8; 15/227
See application file for complete search history.

(56) References Cited

U.S. PATENT DOCUMENTS

| | | | | | |
|---|---|---|---|---|---|
| 722,863 | A | * | 3/1903 | Lodge | 15/227 |
| 2,251,027 | A | * | 7/1941 | Baker | 2/16 |
| 2,279,100 | A | | 4/1942 | Worth et al. | |
| 2,782,912 | A | * | 2/1957 | Humphrey | 206/362 |
| 3,183,543 | A | | 5/1965 | Worcester | |
| 3,298,507 | A | * | 1/1967 | Micciche | 206/361 |
| 3,329,985 | A | * | 7/1967 | Glowacki, Jr. | 15/104.001 |
| 3,608,708 | A | * | 9/1971 | Storandt | 206/361 |
| 3,638,789 | A | * | 2/1972 | Tuszewski | 206/438 |
| 4,071,921 | A | | 2/1978 | Jury | |
| 4,347,931 | A | | 9/1982 | Ginger et al. | |
| 4,788,733 | A | | 12/1988 | Lerner | |
| 4,902,283 | A | | 2/1990 | Rojko et al. | |
| 4,959,881 | A | * | 10/1990 | Murray | 15/227 |
| 5,020,160 | A | | 6/1991 | Cano | |
| 5,473,789 | A | | 12/1995 | Oster | |
| 5,509,164 | A | * | 4/1996 | Weill | 15/222 |
| 5,533,209 | A | * | 7/1996 | Davis | 2/60 |
| 5,542,566 | A | | 8/1996 | Glaug et al. | |
| 5,616,201 | A | | 4/1997 | Finch et al. | |
| 5,649,336 | A | * | 7/1997 | Finch et al. | 15/104.94 |
| 5,806,099 | A | | 9/1998 | Grinberg | |
| 5,987,645 | A | | 11/1999 | Teaster | |
| 6,146,365 | A | * | 11/2000 | Nguyen | 604/292 |
| 6,206,863 | B1 | | 3/2001 | Skewes et al. | |
| 6,328,811 | B1 | | 12/2001 | Martin et al. | |
| 6,360,373 | B1 | * | 3/2002 | Rehn et al. | 2/161.6 |
| 6,508,602 | B1 | | 1/2003 | Gruenbacher et al. | |

(Continued)

*Primary Examiner*—Gary L Welch
*Assistant Examiner*—Sally C Cline
(74) *Attorney, Agent, or Firm*—Hasse & Nesbitt LLC; Ronald J. Richter; Daniel F. Nesbitt

(57) ABSTRACT

A disposable cleaning mitten for wearing over the hand when performing hygienic care. The mitten can be used to cleanse, bathe and refresh the skin of a disabled individual, baby, elderly person or oneself, and includes a finger portion to house the fingers and a separate thumb portion for the thumb. Both the exterior and the interior surfaces are intended for use as a cleaning surface. Tear lines or perforations allow the mitten to be converted into a single, elongated sheet, or two separate sheets, so that all sides of the sheet or sheets can be used for cleaning. The mitten can be sized so that the user can wear a latex or surgical glove beneath the mitten so that dirt or other soiled materials do not touch the skin of the hand. The mitten has a grasping means at its open end for grasping to pull the body onto the hand and to tear the body along the tear lines.

11 Claims, 4 Drawing Sheets

U.S. PATENT DOCUMENTS

| | | | | |
|---|---|---|---|---|
| 6,516,469 | B1 | 2/2003 | Schaetzel | |
| 6,530,108 | B1 | 3/2003 | Brown et al. | |
| 6,811,338 | B1 | 11/2004 | Manske et al. | |
| 2001/0047534 | A1* | 12/2001 | Sandusky | 2/158 |
| 2002/0032943 | A1* | 3/2002 | James et al. | 15/227 |
| 2006/0242777 | A1* | 11/2006 | Blokpoel | 15/104.94 |
| 2007/0067932 | A1* | 3/2007 | Young et al. | 15/104.94 |

* cited by examiner

HYGIENIC MITTEN

FIELD OF THE INVENTION

The present invention relates generally to the field of paper cleaning wipes, and more particularly to disposable paper mittens worn on the hands to perform hygienic care, cleanse, bath and refresh the skin of a disabled individual, baby, older person or self.

BACKGROUND OF THE INVENTION

Over the years, consumers have shifted demand from cloth towels to disposable wipes for infants and toddlers. This shift in demand from washable to disposable products has helped to develop the disposable wipe business into a major industry. As this industry has developed, consumers have preferred and often demanded more efficient and easier to use disposable products, such as wipes with better absorbency which are easier to handle with infants and toddlers. Additionally, as the nursing home and elderly care industry has grown, the elderly and disabled individuals often have needed more cost effective and efficient assistance from nursing home or elderly care personnel, including bladder and bowel assistance.

Prior art cleaning wipes have attempted to provide disposable wipes having various different features. For example, U.S. Pat. No. 5,649,336 to Finch et al. discloses a disposable mitt wipe for wiping and cleaning waste from the body. The wipe is intended for use both by and on children, and includes a mitt body having a top layer and a bottom layer which form an interior space and an open end for insertion of the user's hand. The mitt can come saturated with a wet cleaning solution, and also includes an access flap for help in finding the interior space and a reinforcing cuff to keep the material around the open end secure.

U.S. Pat. No. 6,530,108 to Brown et al. discloses a cleaning/dusting mitt that includes a section for the palm of the hand, a central section for the fingers, and a compartment on either side of the central section for a thumb. The mitt can be worn on either hand and both sides of the mitt can be used for cleaning without moving the mitt from one hand to the other.

U.S. Pat. No. 6,516,469 to Schaetzel discloses a sanitary mitten for cleaning and wiping babies or older people with bowel control problems. The mitten includes an inner waterproof material and an outer extra-absorbent cloth-like disposable material containing moisturizers. The mitten also has an internal pull tab to aid in removal of the mitten from the hand after use.

U.S. Pat. No. 6,206,863 to Skewes et al. discloses a disposable mitten impregnated with a hydrating, non-ionic cleanser. The mitt can come in a microwave-heatable wrap and then heated up in a microwave prior for use in bathing a patient or for personal bathing. The cleanser is intended to evaporate into the air quickly (especially when heated), leaving the skin clean, soft, soothed, nourished and protected.

U.S. Pat. No. 6,811,338 to Manske, Jr. et al. discloses a disposable, semi-enclosed applicator for distributing a substance onto a target surface. The applicator has a first side, a second side, and an internal cavity between the sides for insertion of a user's hand. One side of the applicator includes "rugosities" for aiding in scrubbing, while the other side is suitable for quickly absorbing excess cleaning solution and buffing a surface to a streak-free shine.

Although the above inventions may be useful for their intended purposes, there remains a need for a disposable hygienic mitten which is easy to put on and to remove and which both the inside and the outside of the mitten can be used for cleaning.

SUMMARY OF THE INVENTION

In light of the foregoing, the present invention generally includes a disposable mitten which is typically used for cleaning children, the elderly, and disabled or hospitalized individuals, such as those patients suffering from mental retardation, developmental delay, or recovering from a stroke.

The mitten is typically moist on all sides and can easily be opened to expose the interior surfaces, or separated into sheets for use of all of its surfaces for cleaning. The mitten is typically perforated along its periphery to provide tear lines for easy removal and use of all of its cleaning surfaces, and typically includes a handle or grasping means to aid the user in donning and removal of the mitten, such as a finger loop. The mitten can also include grooves built in to at least one surface, as is known in the art, to provide a scrubbing surface for cleaning. The mitten is intended to provide better control in wiping the bottoms of children and the elderly, but can be used on any skin surface or any surface to be cleaned. The materials used to make the mitten are typically moist, extra absorbent, cloth-like, biodegradable and disposable materials, so that after use the mitten can be flushed down the toilet or otherwise easily disposed of.

More specifically, a first aspect of the invention provides a disposable cleaning mitten, comprising: (a) a body comprising a front layer and a back layer joined along a periphery to define a closed end having a thumb portion and a finger portion, an open end having an opening including a thumb side and a finger side, and an interior space for receiving a user's hand through the open end, wherein both the front layer and the back layer have an exterior-facing surface and an interior-facing surface, each exterior-facing surface providing an exterior cleaning surface, each interior-facing surface providing an interior cleaning surface; (b) a first tear line beginning at the thumb side of the open end and extending along the thumb portion of the closed end, (c) a second tear line beginning at the finger side of the open end and extending along the finger portion of the closed end; and (d) a grasping means attached to the open end and adapted for grasping to pull the body onto the hand and to tear the body along the first tear line and the second tear line.

A second aspect of the invention provides a disposable cleaning mitten, comprising: (a) a body comprising a front layer and a back layer joined along a periphery to define a closed end having a thumb portion and a finger portion, an open end having an opening including a thumb side and a finger side, and an interior space sized to receive a user's hand which is wearing a plastic film glove, wherein both the front layer and the back layer have an exterior-facing surface and an interior-facing surface, each exterior-facing surface providing an exterior cleaning surface, each interior-facing surface providing an interior cleaning surface; (b) a tear line extending along the periphery of the closed end, the tear line adapted for separation of the body into a first sheet and a second sheet; and (c) a grasping means extending from at least one of the front layer and the back layer of the open end and adapted for grasping to pull the body onto the hand and to tear the body along the tear line, wherein the grasping means is sized to accommodate at least three fingers of a user.

A third aspect of the invention provides a disposable cleaning mitten comprising: (a) a mitten-shaped body comprising a closed end having a thumb portion and a finger portion, an open end having a thumb side and a finger side, an interior space for receiving a user's hand through the open end, an exterior-facing surface providing an exterior cleaning surface, and an interior-facing surface providing an interior cleaning surface; (b) a fold line in the mitten-shaped body at approximately opposite the open end; (c) a first tear line beginning at the thumb side of the open end and extending along the thumb portion of the closed end up to the fold line; (d) a second tear line beginning at the finger side of the open end and extending along the finger portion of the closed end up to the fold line; and (e) a grasping means extending from the open end of the body, the grasping means adapted for grasping to pull the body onto the hand, wherein the body is adapted to be torn along the tear lines to open the body into a single sheet to expose the interior-facing surface.

The nature and advantages of the present invention will be more fully appreciated from the following drawings, detailed description and claims.

BRIEF DESCRIPTION OF THE DRAWINGS

The accompanying drawings illustrate embodiments of the invention and, together with a general description of the invention given above, and the detailed description given below, serve to explain the principles of the invention.

DETAILED DESCRIPTION OF THE INVENTION

The definitions of several terms are first provided to assist the reader in understanding the present invention.

As used herein, the term "disposable" describes devices which generally are not intended to be laundered or otherwise restored or reused, i.e., they are intended to be discarded after a single use and preferably recycled, composted or otherwise disposed of in an environmentally compatible manner.

As used herein, the term "mitten" refers to a covering for the hand having an enclosure that leaves the fingers unseparated and a separate enclosure for the thumb.

As used herein, the term "sheet" refers to a planar structure lacking the interior space of a mitten.

As used herein, the term "tear line" means a line of perforations, grooves, indentations or weaknesses in the material of the mitten body of the invention, which allows the material to be reliably separated along a desired plane. Typically tear lines provide lines of weakness for separation of the body of the mitten along its periphery.

Figure 1:
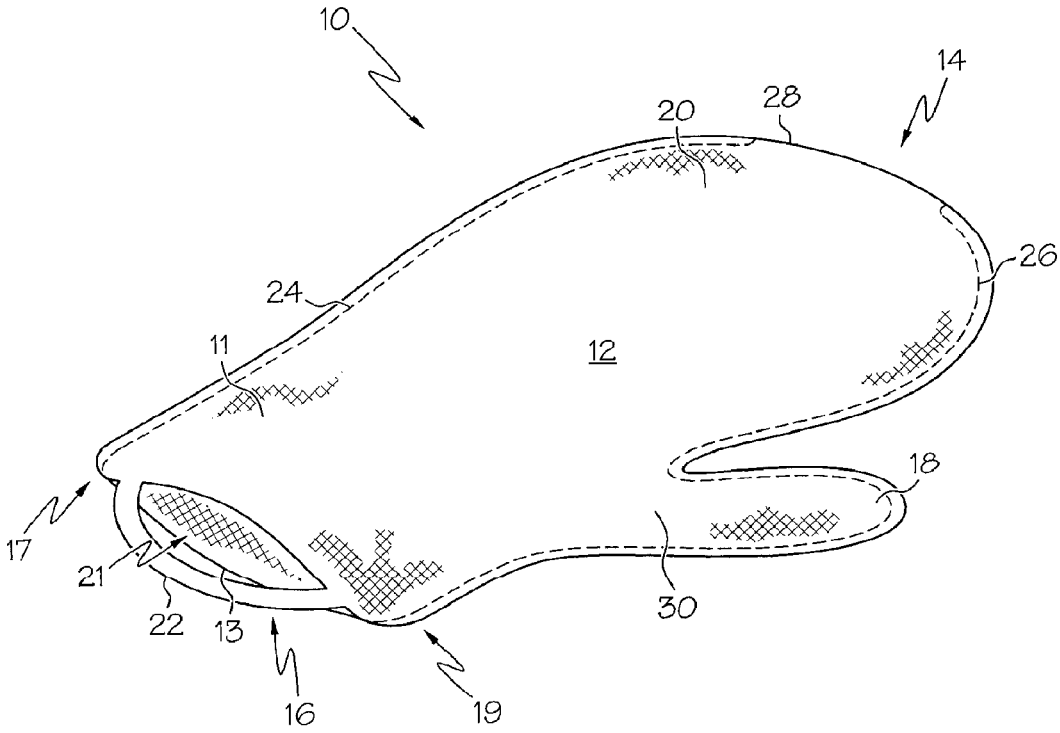
FIG. 1 is a perspective view of one embodiment of the hygienic mitten of the present invention.

FIG. 1 illustrates a perspective view of a mitten 10 of the invention, which includes a body 12 made up of a front layer 11 and a back layer 13. The front and back layers 11, 13 are joined along their peripheries to form a closed end 14 having a thumb portion 18 and a finger portion 20. An open end 16 provides an opening between the front layer 11 and the back layer 13, which allows a user's hand to enter the interior space 21 of the mitten body 12. A grasping means 22, such as handle or finger loop, is attached at the open end 16 to allow the user to locate the opening and guide the hand into the interior space 21. The grasping means 22 also allows the user to grasp and remove the glove after use, typically by tearing the body 12 along the tear lines 24, 26.

Tear lines 24, 26 are located about the periphery of the glove. In the embodiment shown, a first tear line 26 begins at the thumb side 19 of the open end 16 and extends along the thumb portion 18 of the closed end 14 and partially into the finger portion 20, and a second tear line 24 begins at the finger side 17 of the open end 16 and extends along the finger portion 20 of the closed end 14. Both the first and second tear lines 24, 26 extend up to, and/or are connected in series to, a fold line 28 which is located at the closed end 14 of the body 12, approximately opposite the open end 16.

In addition to providing an easy means for donning and removing the mitten, typically the grasping means 22 is sized to accommodate at least three fingers of a user to provide the user with a reliable means to generate adequate force for tearing of the tear lines 24, 26. This is especially useful for disabled or elderly individuals. The tear lines typically begin at the open end 16 of the mitten on either side of the grasping means 22, to provide for easy tearing by pulling on the grasping means 22 towards the closed end 14.

As shown in FIG. 1, the front layer 11 of the mitten body 12 has an exterior-facing surface 30, which provides an exterior cleaning surface for cleaning on one side of the mitten. The back layer 13 of the body 12 also has an exterior-facing surface (not shown), which also provides an exterior cleaning surface on the flip side of the mitten. Prior to tearing the mitten along the tear lines, the exterior cleaning surfaces of the mitten can be used for hygienic care. Although FIG. 1 depicts the body 12 as being manufactured from a front layer 11 and a back layer 13, the disposable mitten of the invention can also be fashioned from a single piece of material forming a mitten-shaped body having an exterior surface, an interior space and an interior surface.

Figure 2:
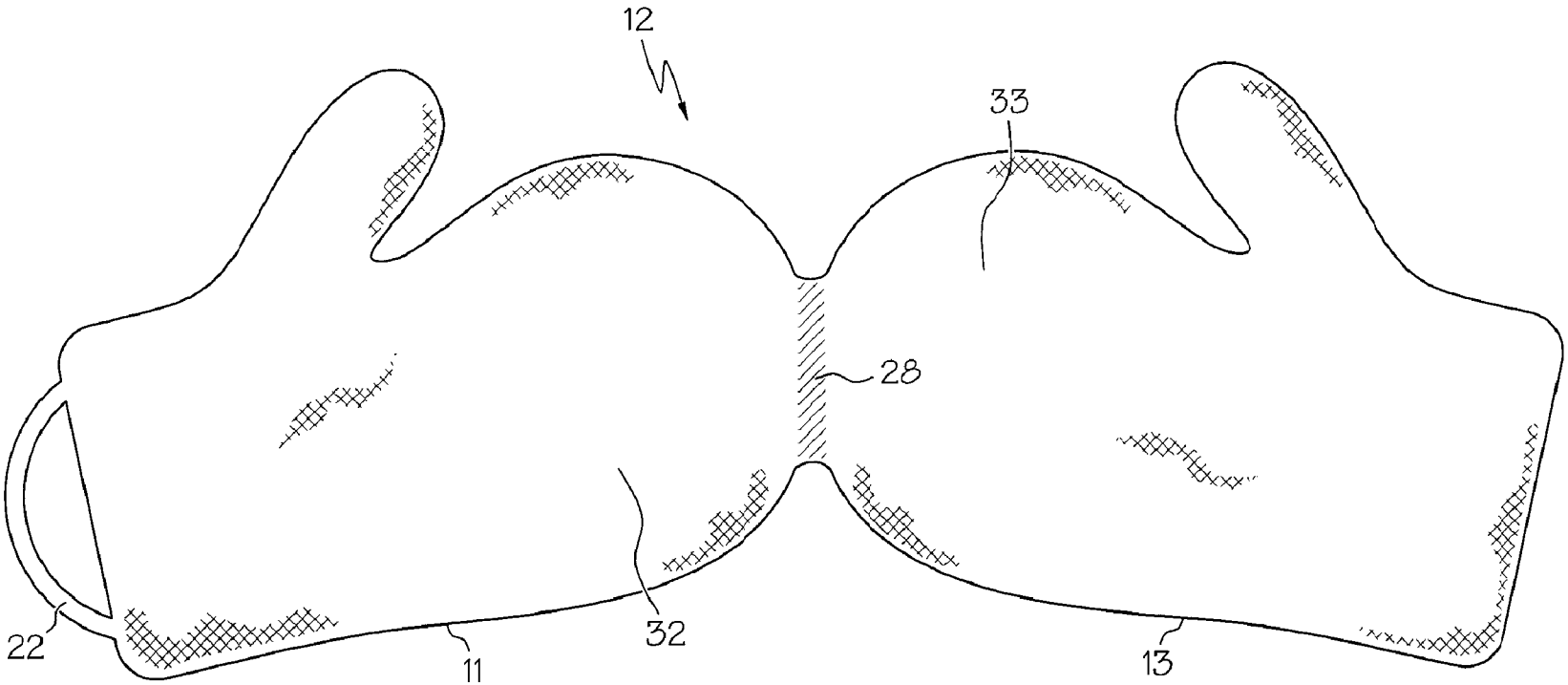
FIG. 2 illustrates the mitten of FIG. 1 after it has been torn along the tear lines, according to the invention.
Figure 3:
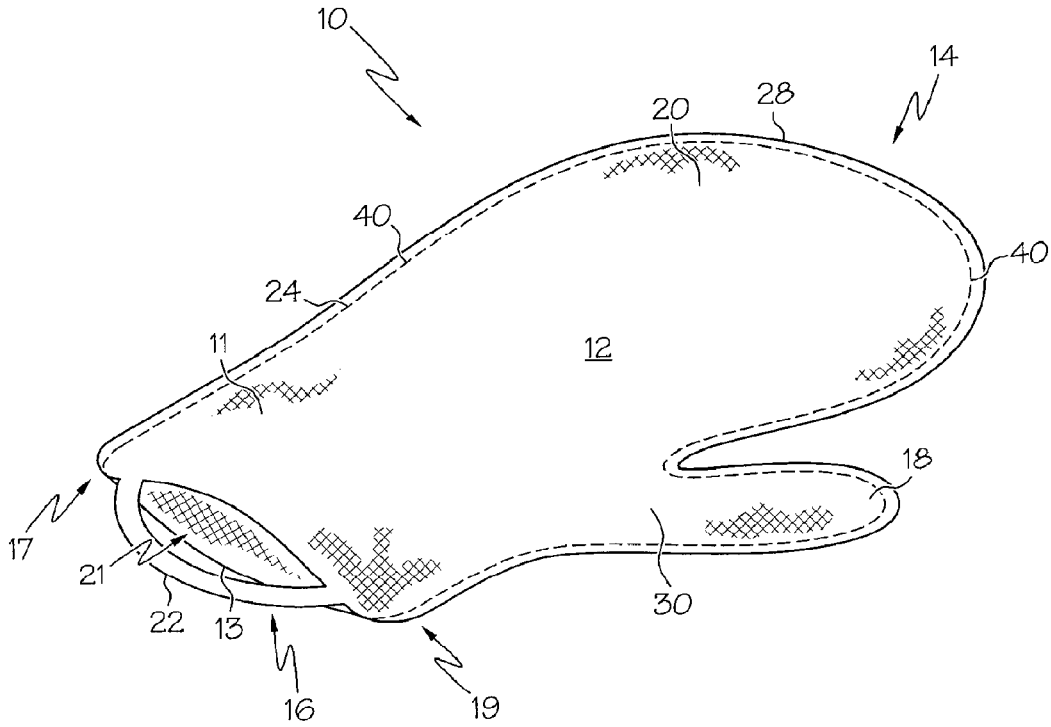
FIG. 3 is a perspective view of another embodiment of the hygienic mitten of the present invention.
Figure 4:
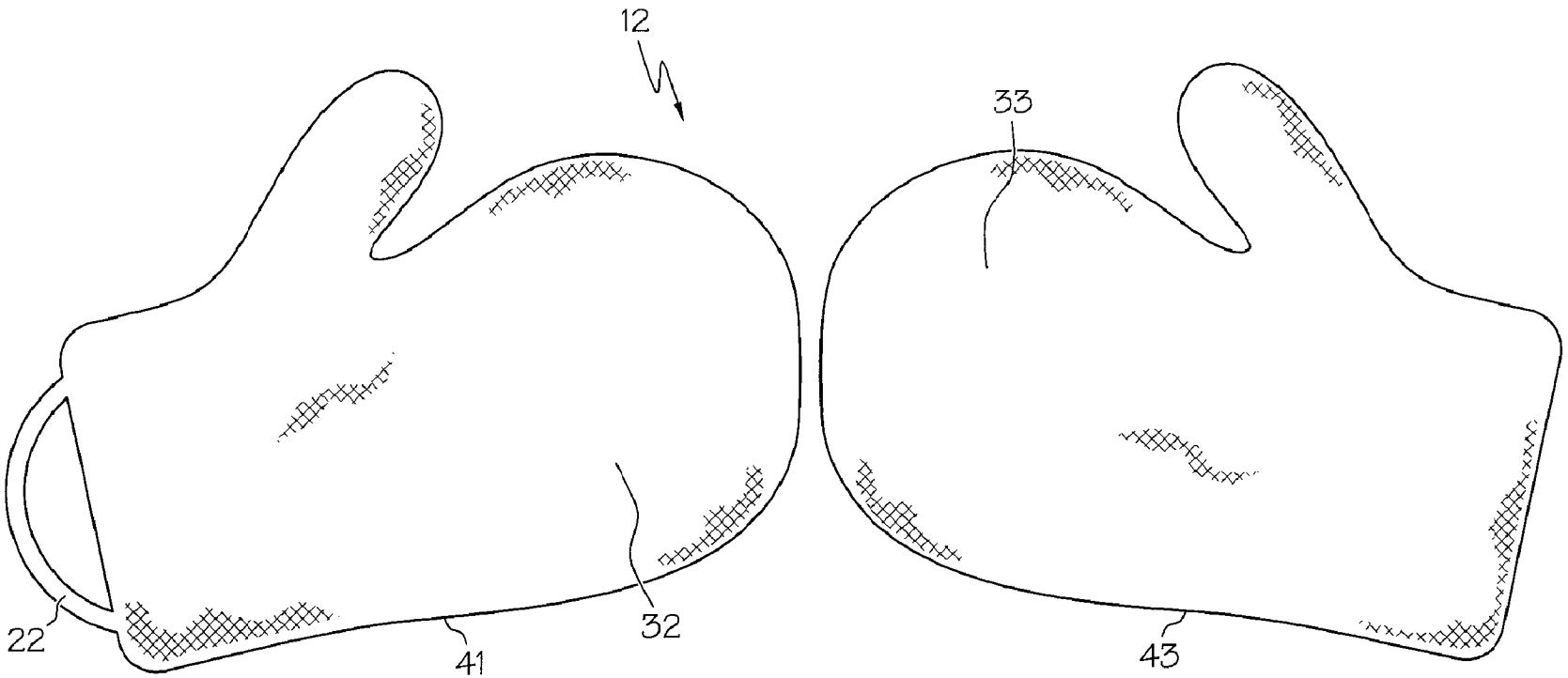
FIG. 4 illustrates the mitten of FIG. 3 after it has been torn along the tear lines, according to the invention.

FIG. 2 illustrates the mitten of FIG. 1 after it has been torn along the tear lines, to expose the interior-facing surfaces 32, 33 of the mitten body 12. The front layer 11 of the body 12 includes interior-facing surface 32 which provides an interior cleaning surface, and the back layer 13 includes interior-facing surface 33 which provides another interior cleaning surface. The interior-facing surfaces 32, 33 had previously been part of the interior space 21 of the mitten 10 in FIG. 1. Fold line 28 allows the mitten to remain intact as a single, elongated sheet for cleaning. Indeed, the sheet can now be folded along the fold line 28 and be used much like an ordinary cleaning wipe, allowing the interior cleaning surfaces as well as the exterior cleaning surfaces to be used for hygienic care. In another embodiment shown in FIGS. 3 and 4, the first and second tear lines of FIG. 1 do not end at a fold line, but rather are continuous with one another along the periphery of the closed end to form a single tear line 40, such that tearing the body 12 of the mitten completely along the single tear line 40 separates the mitten into two individual sheets 41, 43 for cleaning, with each sheet having its exterior and interior cleaning surfaces exposed and available for cleaning.

The mitten of the invention is intended to be a cost-efficient tool, so that the individual using it can tear the mitten at the tear lines and use the interior-facing surfaces as well as the exterior-facing surfaces thereof. Both the exterior and interior cleaning surfaces may be used as wiping surfaces for cleaning. Also, since the mitten may become soiled on the exterior surfaces prior to tearing along the tear lines, the interior space of the mitten can be sized so that it can accommodate a user's hand which is wearing a plastic film glove or surgical glove to prevent exposure of their skin to moisture, dirt, fecal material, urine, menses or other materials present on the area to be washed. This allows the user to employ both the exterior and the interior surfaces of the glove without worrying about exposing their skin to the soiled surfaces. In this manner, all surfaces of the mitten can be used to clean bodily fluids and excretions, which provides a very cost efficient tool for hygienic cleansing, especially with patients in a hospital setting.

Preferably the mitten is breathable and comfortable to wear, and after use can be flushed down the toilet or otherwise disposed of. The materials used to make the mitten are typically extra absorbent, cloth-like, biodegradable and disposable materials, such as cellulosic material similar to paper toweling known in the art. The mitten can thus be used in place of ordinary toilet paper or other cleaning devices.

Further, an individual, such as an infant, toddler, or elderly or disabled or hospitalized person, who has trouble with fine motor control can learn to use the grasping means to slip on the mitten and clean themselves, even though they may lack the motor control to use toilet paper. As a non-limiting example, the mitten can be used as a rehabilitative aide for recovering stroke victims who are learning to initiate self care once again, for individuals who have lost digits from their hands, or for patients recovering from brain trauma. The mitten may optionally be manufactured to contain a fragrance, an antibacterial compound, a disinfectant, or combinations thereof.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope or spirit of the invention.

What is claimed is:

1. A disposable cleaning mitten, comprising:

a. a body consisting of a front layer and a back layer joined along a periphery to define a closed end having a thumb portion and a finger portion, an open end having an opening including a thumb side and a finger side, and an interior space for receiving the fingers and the thumb of a user's hand through the open end, wherein both the front layer and the back layer have an exterior-facing surface and an interior-facing surface, each exterior-facing surface providing an exterior cleaning surface, each interior-facing surface providing an interior cleaning surface;

b. a first line of perforations beginning at the thumb side of the open end and extending along the periphery of the thumb portion of the closed end;

c. a second line of perforations beginning at the finger side of the open end and extending along the periphery of the finger portion of the closed end; and d. a grasping means attached to the open end and adapted for grasping to pull the body onto the hand and to tear the body along the first line of perforations and the second line of perforations, wherein the mitten body is adapted to be separated along the lines of perforations in order to open the interior space of the mitten body and expose the interior cleaning surfaces.

2. The disposable cleaning mitten of claim 1, wherein the first and second lines of perforations are connected by a fold line at approximately opposite the open end, wherein the body is adapted to be torn along the lines of perforations to open the body into a single sheet to expose the interior-facing surfaces of the front layer and the back layer.

3. The disposable cleaning mitten of claim 1, wherein the first and second lines of perforations are continuous with one another along the periphery of the closed end and form a single line of perforations, and wherein the body is adapted to be torn along the single line of perforations to separate the body into a first sheet and a second sheet, the first sheet including a first exterior cleaning surface and a first interior cleaning surface, the second sheet including a second exterior cleaning surface and a second interior cleaning surface.

4. The disposable cleaning mitten of claim 1, wherein the grasping means is sized to accommodate at least three fingers of a user.

5. The disposable cleaning mitten of claim 1, wherein the single interior space of the body is sized to accommodate a user's hand which is wearing a plastic film glove.

6. A disposable cleaning mitten, comprising:

a. a body consisting of a front layer and a back layer joined along a periphery to define a closed end having a thumb portion and a finger portion, an open end having an opening including a thumb side and a finger side, and a single interior space sized to receive the fingers and the thumb of a user's hand which is wearing a plastic film glove, wherein both the front layer and the back layer have an exterior-facing surface and an interior-facing surface, each exterior-facing surface providing an exterior cleaning surface, each interior-facing surface providing an interior cleaning surface;

b. a line of perforations extending along the periphery of the closed end, the line of perforations adapted for separation of the body into a first sheet and a second sheet; and c. a grasping means extending from at least one of the front layer and the back layer of the open end and adapted for grasping to pull the body onto the hand and to tear the body along the line of perforations, wherein the grasping means is sized to accommodate at least three fingers of a user, and wherein the mitten body is adapted to be separated along the lines of perforations in order to open the interior space of the mitten body and expose the interior cleaning surfaces.

7. The disposable cleaning mitten of claim 6, wherein a fold line interrupts the line of perforations at approximately opposite the open end, the fold line separating the line of perforations into a first line of perforations and a second line of perforations, the first line of perforations beginning at the thumb side of the open end and extending along the periphery of the thumb portion of the closed end up to the fold line, the second line of perforations beginning at the finger side of the open end and extending along the periphery of the finger portion of the closed end up to the fold line, and wherein the body is adapted to be torn along the lines of perforations to open the body into a single sheet to expose the interior-facing surfaces, and wherein the single sheet can be folded along the fold line.

8. A disposable cleaning mitten comprising:

a. a mitten-shaped body consisting of a closed end having a thumb portion and a finger portion, an open end having a thumb side and a finger side, a single interior space for receiving the fingers and the thumb of a user's hand through the open end, an exterior-facing surface providing an exterior cleaning surface, and an interior-facing surface providing an interior cleaning surface;

b. a fold line in the mitten-shaped body at approximately opposite the open end;

c. a first line of perforations beginning at the thumb side of the open end and extending along the periphery of the thumb portion of the closed end up to the fold line;

d. a second line of perforations beginning at the finger side of the open end and extending along the periphery of the finger portion of the closed end up to the fold line; and e. a grasping means extending from the open end of the body, the grasping means adapted for grasping to pull the body onto the hand, wherein the body is adapted to be separated along the lines of perforations in order to open the interior space of the mitten body into a single sheet and to expose the interior-facing surface.

9. The disposable cleaning mitten of claim 8, wherein the grasping means is sized to accommodate at least three fingers of a user.

10. The disposable cleaning mitten of claim 8, wherein the first and second lines of perforations extend into the fold line and are continuous with one another therein to form a single line of perforations around the periphery of the closed end of the mitten, and wherein the body is adapted to be torn along the single line of perforations to separate the body into a first sheet and a second sheet, the first sheet including a first exterior cleaning surface and a first interior cleaning surface, the second sheet including a second exterior cleaning surface and a second interior cleaning surface.

11. The disposable cleaning mitten of claim 8, wherein the single interior space of the body is sized to accommodate a user's hand which is wearing a plastic film glove.

* * * * *

UNITED STATES PATENT AND TRADEMARK OFFICE

CERTIFICATE OF CORRECTION

PATENT NO. : 7,681,250 B2
APPLICATION NO. : 11/624484
DATED : March 23, 2010
INVENTOR(S) : Stephanie J. Friedstrom It is certified that error appears in the above-identified patent and that said Letters Patent is hereby corrected as shown below:

Claim 1, line 5, delete "an" and insert --a single--.

Signed and Sealed this
Twenty-second Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,681,250 B2
APPLICATION NO. : 11/624484
DATED : March 23, 2010
INVENTOR(S) : Stephanie J. Friedstrom It is certified that error appears in the above-identified patent and that said Letters Patent is hereby corrected as shown below:

Column 5, line 36 (Claim 1, line 5), delete “an” and insert --a single--.

This certificate supersedes the Certificate of Correction issued February 22, 2011.

Signed and Sealed this
Twenty-second Day of March, 2011

David J. Kappos

David J. Kappos
*Director of the United States Patent and Trademark Office*